US005601187A

United States Patent [19]

Sheng-Wen

[11] Patent Number: 5,601,187

[45] Date of Patent: Feb. 11, 1997

[54] DUPLICATE NOTEPAPER CASE

[76] Inventor: Lin Sheng-Wen, 4F, No. 335, Sec. 3, Chen Tai Rd., Wu Ku Hsiang, Taipei Hsien, Taiwan

[21] Appl. No.: 624,168

[22] Filed: Mar. 29, 1996

[51] Int. Cl.[6] ..... A45C 11/34

[52] U.S. Cl. ..... 206/214; 206/215; 206/224; 220/23.83; 40/109

[58] Field of Search ..... 206/214, 215, 206/224, 371, 581, 823; 40/107, 109, 110, 358; 220/23.83

[56] References Cited

U.S. PATENT DOCUMENTS

| | | | |
|---|---|---|---|
| 4,111,299 | 9/1978 | Taub | 206/215 |
| 4,176,743 | 12/1979 | Fitzpatrick | 206/214 |
| 4,696,399 | 9/1987 | Windorski | 206/215 |
| 4,717,024 | 1/1988 | Djezovic | 220/23.83 |
| 5,358,100 | 10/1994 | Wolff | 206/581 |
| 5,487,466 | 1/1996 | Robson | 206/371 |

FOREIGN PATENT DOCUMENTS

| | | | |
|---|---|---|---|
| 2075429 | 11/1981 | United Kingdom | 206/214 |

*Primary Examiner*—Paul T. Sewell
*Assistant Examiner*—Nhan Lam
*Attorney, Agent, or Firm*—Harrison & Egbert

[57] ABSTRACT

A duplicate notepaper case consists of a main case body, a subordinate case body, a perpetual calendar socket and a moveable pen inserting socket, whereas the main case body is a sandwich space formed by an upper cover and a bottom socket, its hollow interior is a concave to accommodate notepaper, the pen socket mounted in the central back portion of the main case body has an arm at its side which has a shaft pin pivoted in the corresponding shaft hole in the main case body so that the pen socket can swing to one side of the main case body by means of the shaft pin.

15 Claims, 3 Drawing Sheets

DUPLICATE NOTEPAPER CASE

BACKGROUND OF THE INVENTION

A duplicate notepaper case is a mini desk-type stationary, it provides two sizes of notepaper in a duplicate case which has a moveable pen inserting socket and which also has a mini perpetual calendar which an be obviously seen.

SUMMARY OF THE INVENTION

A duplicate notepaper case consists of a main case body, a subordinate case body, a perpetual calendar socket and a moveable pen inserting socket, whereas the main case body is a sandwich space formed by an upper cover and a bottom socket, its hollow interior is a concave to accommodate notepaper, the pen socket mounted in the central back portion of the main case body has an arm at its side which has a shaft pin pivoted in the corresponding shaft hole in the main case body so that the pen socket can swing to one side of the main case body by means of the shaft pin.

BRIEF DESCRIPTION OF THE INVENTION

| | | | |
|---|---|---|---|
| 10 | main case body | 11 | upper cover |
| 111 | push tape | 112 | shaft hole |
| 12 | bottom socket | 121 | reverse hook |
| 122 | reverse hook | 13 | paper slot |
| 14 | outlet | 141 | opening |
| 15 | concave | 20 | subordinate case body |
| 21 | cover | 211 | reverse hook |
| 212 | reverse hook | 22 | slot |
| 23 | outlet | 30 | case cover |
| 31 | cover socket | 311 | bottom slot |
| 312 | locating slot | 313 | top slot |
| 314 | convex shaft | 32 | digital plate |
| 321 | hole slot | 322 | reverse hook |
| 323 | reverse hook | 324 | date matrix |
| 325 | blank area | 33 | sliding board |
| 331 | locating tenon | 332 | push rod |
| 333 | days of a week | 334 | color block |
| 40 | pen socket | 41 | socket main body |
| 411 | pen inserting hole | 42 | arm |
| 43 | shaft pinb | 44 | locating tenon |
| 50 | notepaper | 60 | note paper |

DETAILED DESCRIPTION OF THE PREFERRED EMBODIMENT

Figure 1:
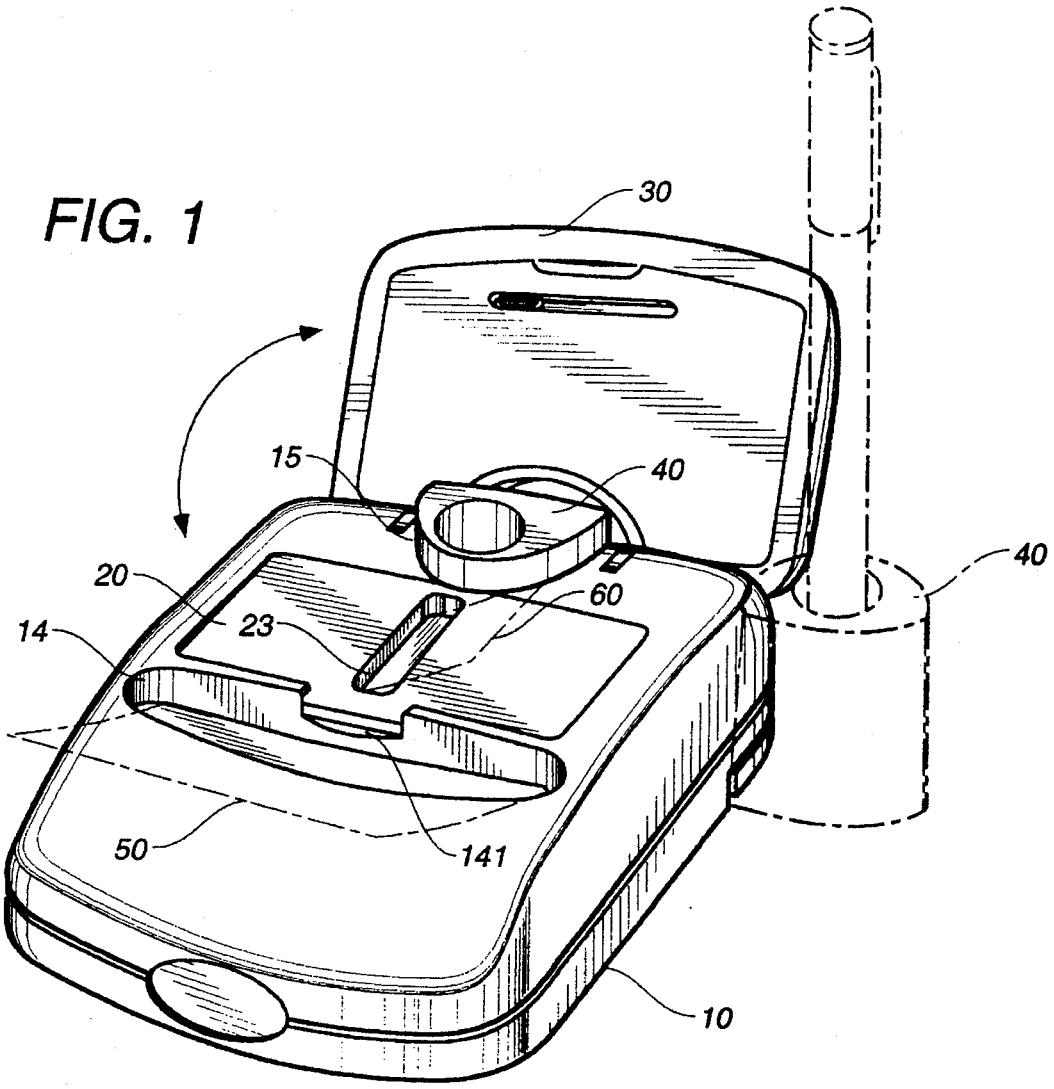
FIG. 1 is a schematic view of exterior of the present invention.

As shown in FIG. 1, a schematic view of exterior of the present invention, the invention cconsists of a main case body (10), a subordinate case body (20) which is mounted in the upper rear laminate portion of the main case body (10), a cover (30) which can cover on the subordinate case body (20) and which is also a socket for a perpetual calendar. The main case body (10) has a recess in the central back to accommodate a pen socket (40) which can swing to one side of the main case body (10).

Figure 2:
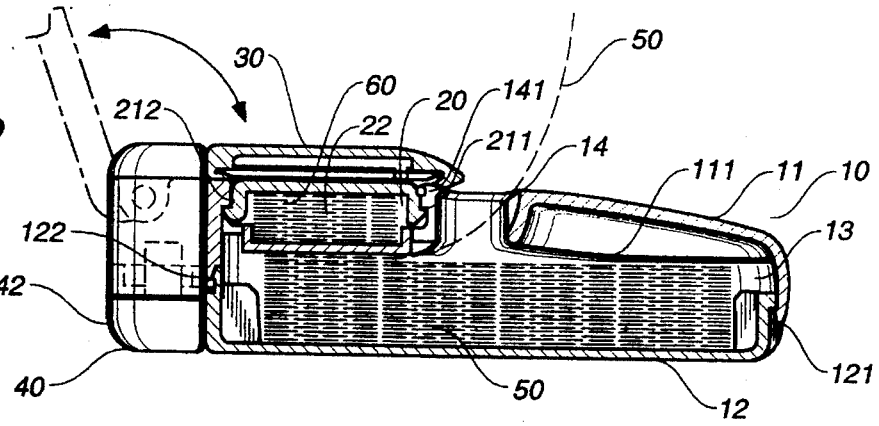
FIG. 2 is a side-sectional view of main case body reserving the notepaper for use.

As shown in FIG. 2, a side-sectional view of main case body reserving the notepaper for use, there can be two different sizes of notepaper for the user to choose for use. The so-called large size only means one of the two different sizes used for the invention. Each one piece of the notepaper is piled on the other and each is attached to the next one by the right or left side edge in turn. When the first piece is drawn out, the next will be partly drawn out and its front end will extend out of the opening (The notepaper in the present invention is a conventional type). As shown in FIG. 2, an upper cover (11) and a bottom socket (12) combine to form a hollow main case body (10) in which the hollow interior can accommodate a paper slot (13) for a large size notepaper (50). Upper cover (11) and lower cover (12) is combined by means of front and back reverse hook (121) (122). Upper cover (11) has a long slot outlet (14) at its central portion and notepaper (50) can be drawn out from the outlet (14) in turn.

Figure 3:
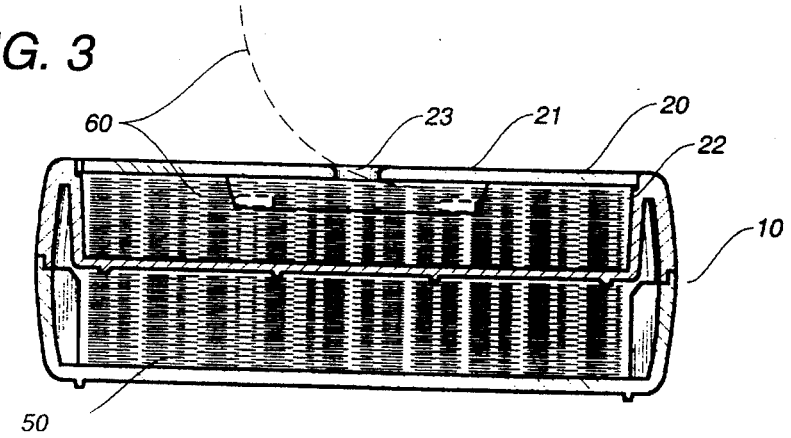
FIG. 3 is a horizontal sectional view of subordinate case body reserving the notepaper for use.

The subordinate case body (20) is formed by a laminate slot (22) in the upper rear portion. (As shown in FIG. 2). On the upper portion of the subordinate case body (20), there disposed a cover (21) with two elastic reverse hooks (211, 212) at its front and back ends. There disposed an opening (141) in the middle of outlet (14) of upper cover of the main case body (10) (As shown in FIG. 1) so that a part of the cover (21) can expose itself and that the user can reach the cover (21) through the opening (141) and open the cover (21). The hollow slot (22) of subordinate case body (20) is used to accommodate a small size note paper (60) (as shown in FIG. 3) The small size notepaper is vertically drawn out, but the large size notepaper is horizontally drawn out.

Figure 4:
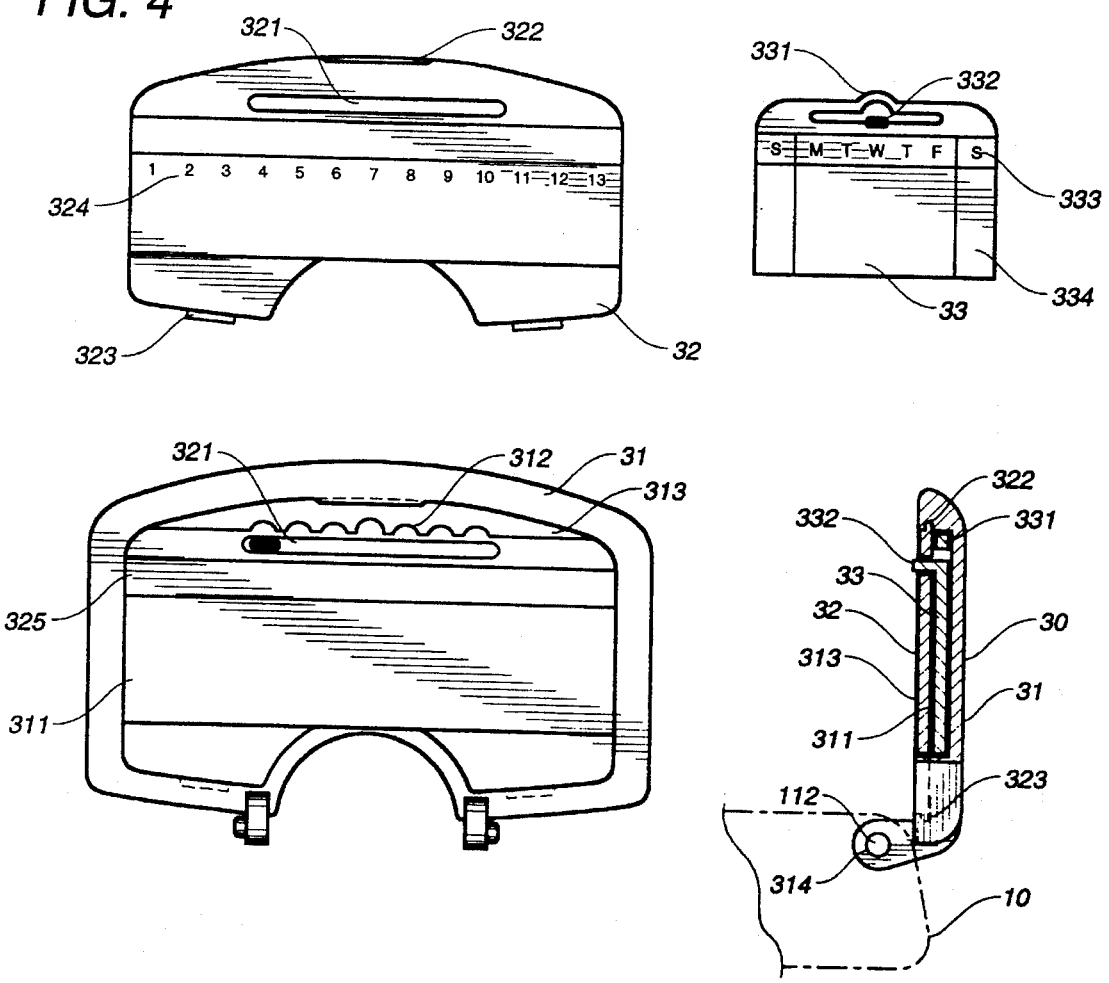
FIG. 4 is a structural view of the cover and the perpetual calendar.

A case cover (30) covers on the subordinate case body (20) (as shown in FIG. 2) and the case cover (30) is also a socket for a perpetual calendar. A case cover socket (31) has a pair of convex shaft (314) at its end to pivot the shaft hole (112) on the back of the main case body (10) so that the cover socket (31) can lift and open. As shown in FIG. 4, a structural view of the cover and the perpetual calendar, the case cover socket (31) is a case body having an inner slot of two steps; that is, a bottom slot (311) and a top slot (313). The top slot (313) accommodates a digital plate (32) with two reverse hooks (322, 323) to retain on the cover socket (31). The digital plate (32) has a hole slot (321) and a stripe of blank area (325) on its lower portion and a date matrix (324) of hollow digits surrounded in light proof color, the digital plate (32) is made of transparent materials, except the blank area (325) and date matrix (324), all their surrounding is in light-proof color; a sliding board (33) is a rectangular board with three color blocks (334) printed on its surface; letters represent days of a week (333) are horizontally listed on the upper portion, a color block (334) is used to distinguish Sunday and Saturday from Monday through Friday; a sliding board (33) is used as a welt beneath the digital plate (32) and serves as a foil to show the digits in brighter color; the sliding board (33) has both an elastic locating tenon (331) on its top and a push rod (332) extending vertically from the front of the board (33). The push rod (332) penetrates a hole slot (321) of the digital plate (32) so that the user can push it to fit the digital area to adjust the date for the year; the locating tenon (331) is used to fit the locating slot (312) on the top of the bottom slot (311) of the socket main body (31) so that the sliding board (33) can be moved stably to locate and fit the proper digital area.

Figure 5:
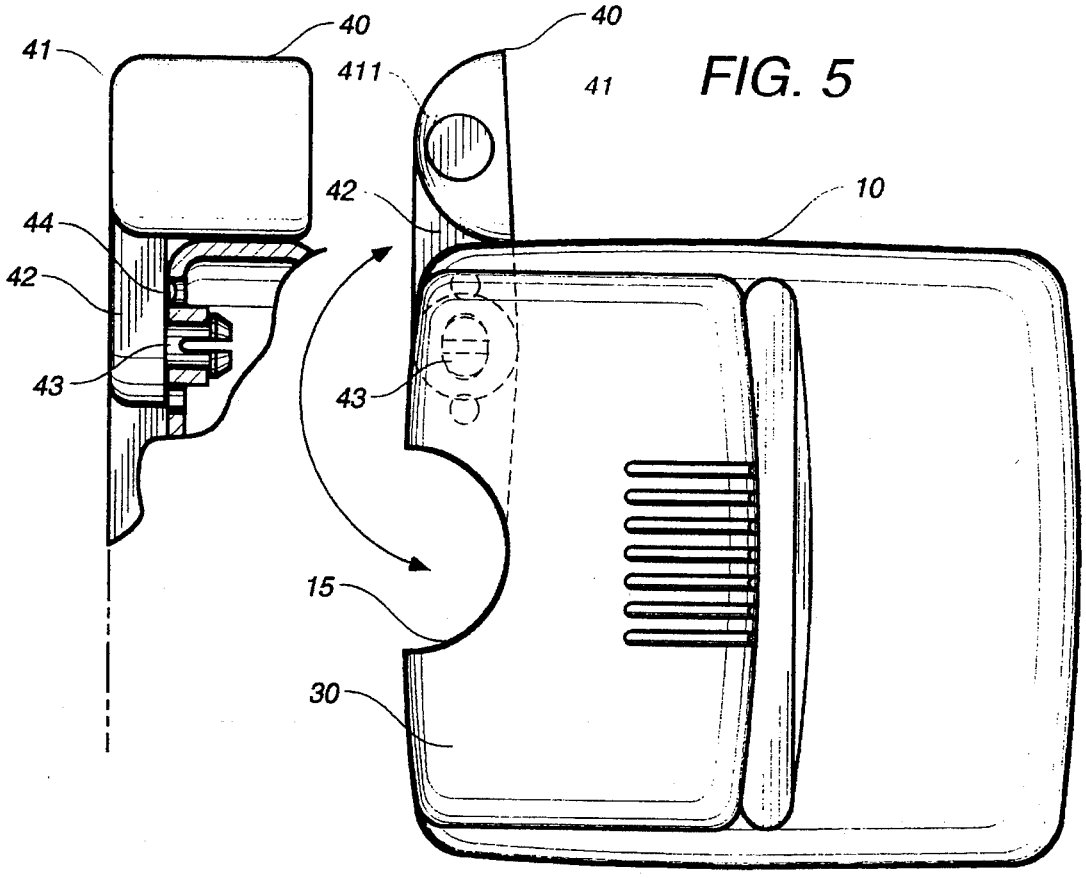
FIG. 5 is a schematic top view of the structure of a pen stand and how it works.

As shown in FIG. 5, a schematic top view of the structure of a pen stand and how it works, a pen socket (40) shaped like an "L" has an upright socket main body (41) at its end. There disposed a pen inserting hole (411) on the socket main bady (41) to fit and be accommodate in the concave (15) in the back of the socket main body (41) which has an arm (42) at its side which has a shaft pin (43) pivoted in the corresponding shaft hole in the main case body (10) so that the pen socket (40) can swing to one side of the main case body (10) by means of the shaft pin (43). Therefore, when the perpetual calendar socket (30) is uprightly lifted, the inserting hole (411) of the pen socket (40) can swing to the left side, and so even if a pen is inserted in the inserting holle (411), it will not bother the user to look at the perpetual calendar. Of course, if the user does not mind, he can also let the pen socket remain in its original position.

In conclusion, duplicate notepaper case can provide two sizes of notepaper for user to choose for his need so that no notepaper can be wasted. It further provides a swinging pen socket and a perpetual calendar which is easy for the user to look at. It is convenient and its structure is unique.

I claim:

1. A case comprising:

a main case body;

a subordinate case body mounted in said main case body;

a perpetual calendar socket pivotally connected to said main case body so as to movable between a first position covering said subordinate case body and a second position exposing a perpetual calendar in said perpetual calendar socket; and a pen socket pivotally connected to said main case body and movable between a retracted position and an accessible position.

2. The case of claim 1, said main case body defining a notepaper receiving space between an upper cover and a bottom socket.

3. The case of claim 1, said pen socket having an arm connected to a central back portion of said main case body.

4. The case of claim 2, said perpetual calendar socket comprising:

a case cover having a horizontal shaft at a lower end so as to pivot at an end of said main case body.

5. The case of claim 1, said pen socket comprising:

an arm pivotally connected to said main case body; and a socket body affixed to an end of said arm opposite said main case body, said socket body having a pen inserting hole formed therein.

6. The case of claim 2, said notepaper receiving space being concave so as to receive notepaper therein.

7. The case of claim 2, said upper cover having a horizontal opening formed therein, said horizontal opening for dispensing notepaper.

8. The case of claim 2, said subordinate case body formed in a back upper portion of the notepaper receiving space in said main case body, said subordinate case body having a cover with a central opening for dispensing notepaper therethrough.

9. The case of claim 3, said arm of said pen socket having a shaft pin pivotally received in a shaft hole formed in said main case body.

10. The case of claim 4, said perpetual calendar socket further comprising:

a socket body;

a digital plate disposed in said socket body; and a sliding board positioned adjacent said digital plate.

11. The case of claim 9, said main case body having a recess formed at said back portion, said retracted position having said pen socket received within said recess, said accessible position being to a side of said main case body.

12. The case of claim 10, said socket body having a two step slot with an upper slot and a lower slot, said lower slot having a locating slot along its upper edge, said digital plate being attached to said upper slot.

13. The case of claim 10, said socket body having a color block on a front thereof so as to more clearly display digits and letters on said digital plate.

14. The case of claim 10, said sliding board having an elastic tenon engaging a locating slot in the case body.

15. The case of claim 12, said digital plate having hollow digits therein and a long slot along an upper portion of said digital plate, said socket body mounted in said lower slot and movable relative to said digital plate.

* * * * *